US005995900A

United States Patent [19]

Hsiao et al.

[11] Patent Number: 5,995,900

[45] **Date of Patent: *Nov. 30, 1999**

[54] INFRARED TRAFFIC SENSOR WITH FEATURE CURVE GENERATION

[75] Inventors: Stephen Hsiao, Plainview; Joseph Farinaccio, Port Washington; Fred Hauck, Wading River, all of N.Y.

[73] Assignee: Grumman Corporation, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/788,306

[22] Filed: Jan. 24, 1997

[51] Int. Cl.[6] ..... G08G 1/01

[52] U.S. Cl. ..... 701/117; 701/118; 701/119; 348/149

[58] Field of Search ..... 701/117, 118, 701/119; 340/907; 348/148, 149, 164; 364/572, 724.011

[56] References Cited

U.S. PATENT DOCUMENTS

| | | | |
|---|---|---|---|
| 4,433,325 | 2/1984 | Tanaka et al. . | |
| 4,449,144 | 5/1984 | Suzuki . | |
| 4,847,772 | 7/1989 | Michalopoulos et al. . | |
| 4,881,270 | 11/1989 | Knecht et al. . | |
| 5,001,650 | 3/1991 | Francis et al. . | |
| 5,034,986 | 7/1991 | Karmann et al. . | |
| 5,161,204 | 11/1992 | Hutcheson et al. . | |
| 5,212,740 | 5/1993 | Paek et al. . | |
| 5,291,563 | 3/1994 | Maeda . | |
| 5,296,852 | 3/1994 | Rathi | 340/933 |
| 5,353,021 | 10/1994 | Toyama . | |
| 5,402,118 | 3/1995 | Aoki . | |
| 5,404,306 | 4/1995 | Mathur et al. . | |
| 5,416,711 | 5/1995 | Gran et al. | 364/436 |
| 5,448,484 | 9/1995 | Bullock et al. | 364/436 |
| 5,696,502 | 12/1997 | Busch et al. | 340/905 |
| 5,768,131 | 6/1998 | Lissel et al. | 364/461 |

*Primary Examiner*—William A. Cuchlinski, Jr.
*Assistant Examiner*—Arthur D. Donnelly
*Attorney, Agent, or Firm*—Terry J. Anderson; Karl J. Hoch, Jr.

[57] ABSTRACT

The present invention is an infrared traffic sensor with feature curve generation to derive empirical information for determining traffic patterns. A real-time IR image camera is positioned over an automobile and truck traffic thoroughfare for collecting video image data of the traffic thoroughfare. Data in the form of a video signal taken by the infrared video camera is received by a signal processing unit for processing the data. The processed data is used to generate statistical feature curves from which the empirical traffic information such as the number of vehicles, the speed of the vehicles, and the classification of the vehicles are determined.

23 Claims, 7 Drawing Sheets

INFRARED TRAFFIC SENSOR WITH FEATURE CURVE GENERATION

BACKGROUND OF THE INVENTION

1. Field of the Invention

The present invention relates to in general an infrared traffic sensor, and in particular a system and method for generating feature curves to derive empirical information for determining traffic patterns.

2. Related Art

Traffic sensing systems are used to collect traffic data in order to measure the flow of traffic on a roadway or thoroughfare. Typically, equipment of the traffic sensing system is placed in close proximity to the roadway or thoroughfare to physically track vehicles traveling on the roadway or thoroughfare.

One traffic sensing system is a direct contact counting device which includes one or more pneumatic tubes placed across the roadway pavement. Each vehicles traveling on the roadway crosses over the pneumatic tube to actuate a switch that operates a counting device, thereby counting every vehicle that crosses over the tube. Permanent direct counting devices can be actually embedded in the pavement during construction of the roadway. These devices utilize wire loops instead of pneumatic tubes to sense vehicles through magnetic induction.

However, direct contact counting devices are limited in their use. For example, they are not practical for accurately calculating the speed of vehicles or the speed flow of traffic. In addition, pneumatic tube direct contact counting devices are susceptible to miscounts due to multi-axile vehicles, misalignment of the tubes, or proper upkeep. Also, permanent wire loop systems are not practical because they cannot be used for temporary purposes, have accuracy problems similar to the pneumatic tube direct contact counting devices, and are very expensive and usually impractical to install after the roadway is completed.

Other types of traffic sensing systems include camera monitoring systems. These systems typically include a camera placed over a thoroughfare or roadway and collect data in the form of tracked conditions on the roadway. The tracked conditions are sent to a processor which processes the data to calculate characteristics of the traffic conditions.

However, these system are limited because they do not accurately determine the number of vehicles, the speed of the vehicles, and the classification of the vehicles. In addition, many of these systems do not contain signal processing algorithms that can derive empirical information for determining traffic patterns and measure lane density accurately.

Therefore, what is needed is an infrared traffic sensor for generating accurate feature curves to determine the number of vehicles, the speed of the vehicles, and the classification of the vehicles. What is also needed is a traffic sensor and a signal processing algorithm that can derive empirical information for determining traffic patterns. What is further needed is a traffic sensor that can measure lane density accurately.

Whatever the merits of the prior techniques and methods, they do not achieve the benefits of the present invention.

SUMMARY OF THE INVENTION

To overcome the limitations in the prior art described above, and to overcome other limitations that will become apparent upon reading and understanding the present specification, the present invention is an infrared traffic sensor with a novel feature curve generator.

The infrared traffic sensor of the present invention comprises a real-time infrared video camera that is positioned over an automobile and truck traffic thoroughfare. The video camera captures video image data of the traffic thoroughfare. The captured image data is sent to a signal processing unit having a statistical feature curve generator. The statistical feature curve generator processes the image data.

Specifically, the statistical feature curve generator of the signal processing unit receives the incoming video data for deriving a series of quantitative values. These quantitative values are the foundation for a generation of feature curves. An empirical information processor coupled to the feature curve generator receives the feature curves and derives empirical information with an empirical generation algorithm. The data is processed to provide indicia of the number of vehicles, the speed of the vehicles, and the classification of the vehicles. From this lane density can be determined. As such, decisions concerning traffic patterns and flow rates can be made.

An advantage of the present invention is the ability to produce detailed feature curves for estimating accurate vehicle speeds, vehicle lengths, vehicle classifications, and lane density.

The foregoing and still further features and advantages of the present invention as well as a more complete understanding thereof will be made apparent from a study of the following detailed description of the invention in connection with the accompanying drawings and appended claims.

BRIEF DESCRIPTION OF THE DRAWINGS

Referring now to the drawings in which like reference numbers represent corresponding parts throughout.

DETAILED DESCRIPTION OF THE PREFERRED EMBODIMENT

In the following description of the preferred embodiment, reference is made to the accompanying drawings which form a part hereof, and in which is shown by way of illustration a specific embodiment in which the invention may be practiced. It is to be understood that other embodiments may be utilized and structural changes may be made without departing from the scope of the present invention.

Overview

Figure 1:
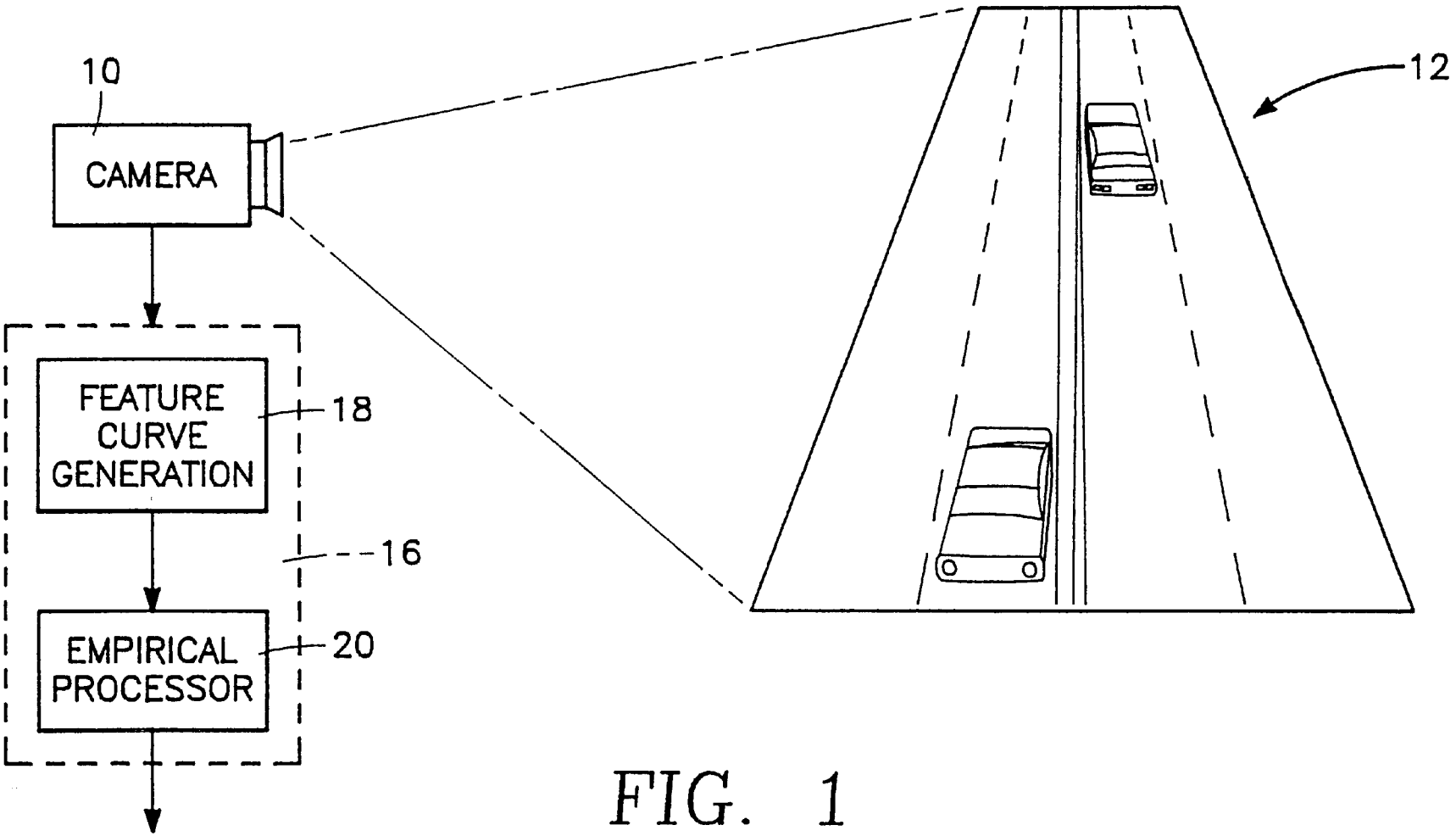
FIG. 1 is an overall block diagram of the present invention.
Figure 2:
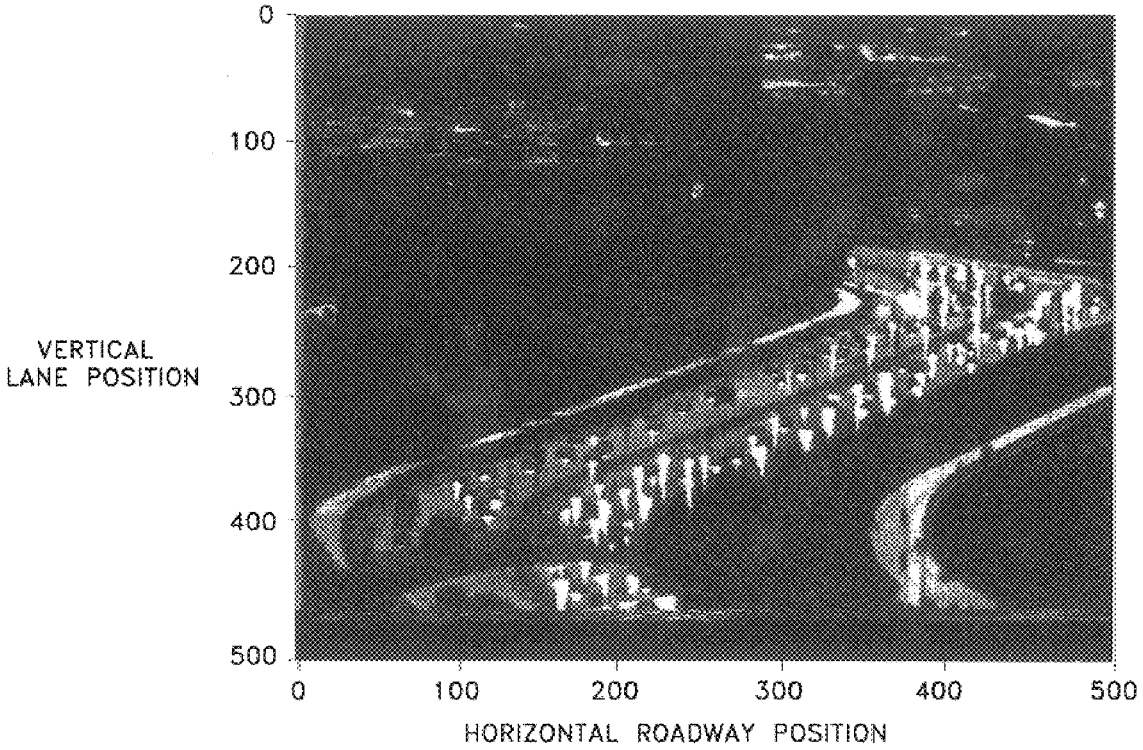
FIG. 2 is a far field of view infrared picture illustrating the capability of the infrared camera.

FIG. 1 is an overall block diagram of the present invention. A real-time infrared camera 10 is positioned over an automobile and truck traffic thoroughfare 12. The video camera 10 captures video image data of the traffic thoroughfare 12 in real-time. In the preferred embodiment, the receiver 10 is a long wave infrared (LWIR) camera. Sample data in the form of video data captured by the infrared video camera is shown in FIG. 2. The video data is sent to a signal processing unit (SPU) 16 having a statistical feature curve generator 18. The SPU 16 can store the video data for future processing, but preferably processes the received video data instantly and in real-time.

In the preferred embodiment, the infrared video data is processed on a 30 frame per second real-time basis. Referring to FIG. 1, the statistical feature curve generator 18 of the signal processing unit 16 receives the incoming video data for deriving a series of quantitative values. These quantitative values are the foundation for a generation of feature curves. An empirical information processor 20 coupled to the feature curve generator 18 receives the feature curves and derives empirical information with an empirical generation algorithm. The data is processed to provide indicia of the number of vehicles, the speed of the vehicles, and the classification of the vehicles. From this lane density can be determined. As such, decisions concerning traffic patterns and flow rates can be made.

Figure 3:
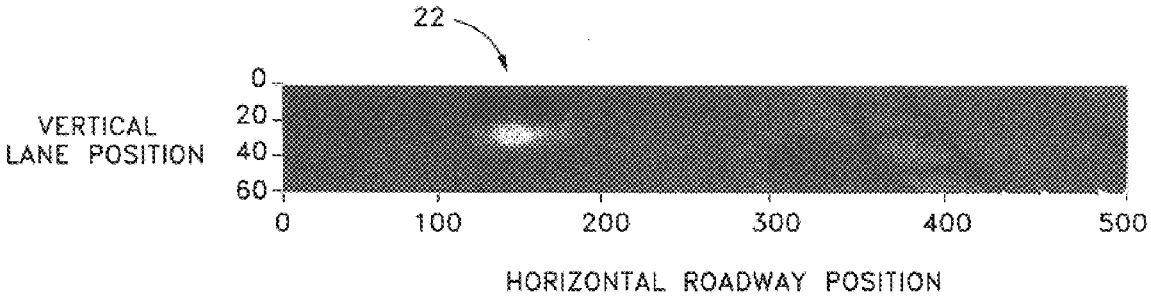
FIG. 3 is a close-up view of a four lane traffic thoroughfare showing the vertical roadway position versus the horizontal roadway position region of interest.

FIG. 3 is a close-up, detailed view showing the vertical roadway position versus the horizontal roadway position of a two dimensional region of interest (ROI) 22. The region of interest 22 comprises a vertical view of preferably one vehicle length and approximately one lane of traffic. Although the length of a vehicle may vary from vehicle to vehicle, the vertical roadway position is set to be equal to an average car length. Additionally, although the width of traffic lanes vary from roadway to roadway, the width is set to be equal to an average roadway width since the width of most lanes are within a few feet. In addition, depending on other system components, operating in real-time may require current capture and analysis processes to work with ROI's 22 of sixty-four video lines.

Figure 4:
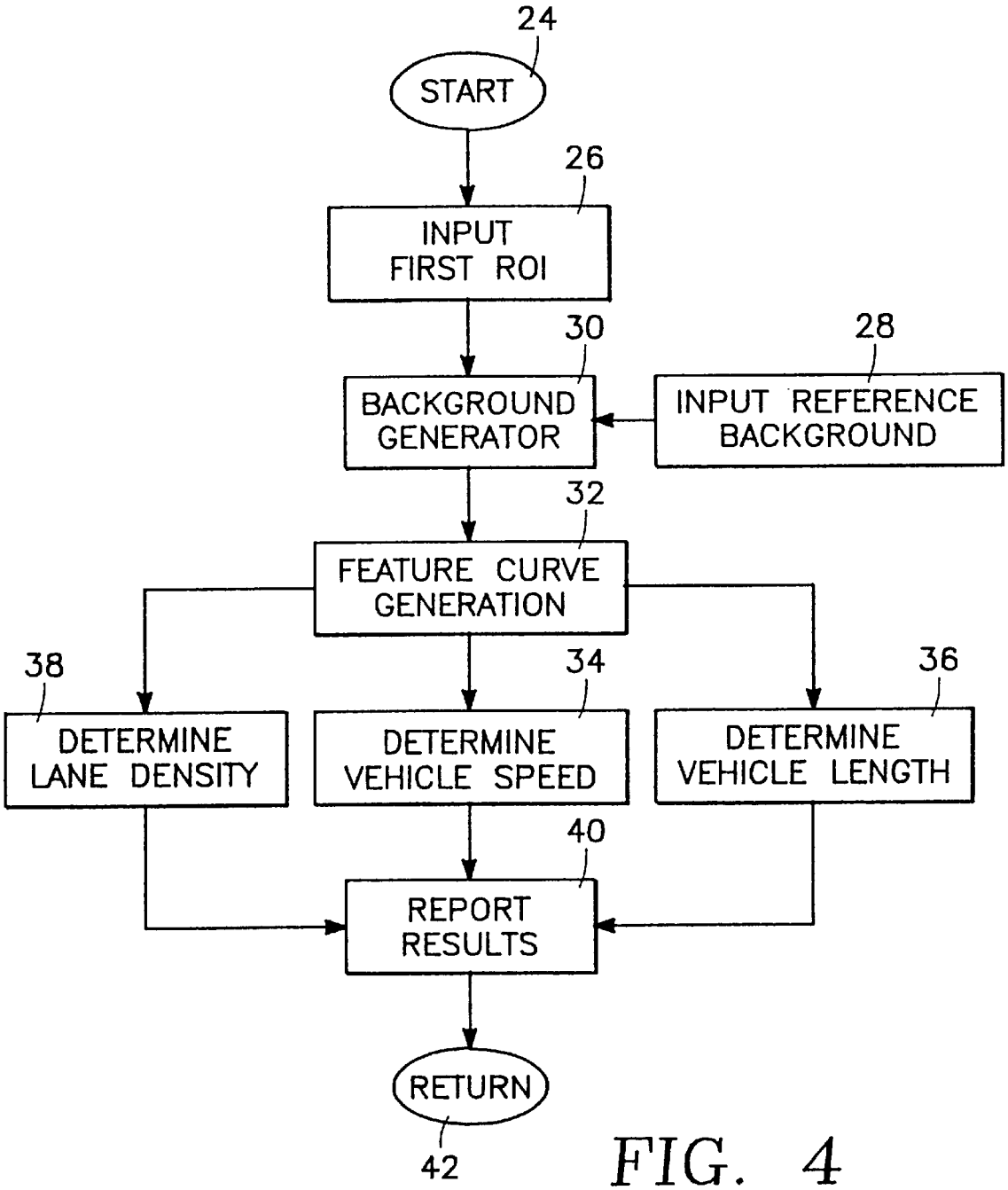
FIG. 4 is a functional flow diagram of the system algorithm used to determine vehicle presence, speed, length, classification and lane density.

FIG. 4 is a functional flow diagram of the algorithm used to generate feature curves and to perform all necessary empirical information extraction The system starts 24 and then inputs 26 a first ROI and a reference background 28 to a background generation 30. Background generation 30 is accomplished by a comparator operative to difference the ROI and a reference background set of values. This comparator removes effects of system noise. Specific algorithms are then used to extract empirical information. Each of these algorithms will be described in detail as follows:

Background Generation Algorithm

Each frame's processing begins with the removal of a set of background values from the two dimensional ROI. This differencing removes the effects of system noise and performance anomalies (including differences in pixel sensitivities) from the resulting data sets. This background generation also allows the effects of environmental parameters like lighting, shadows and weather to be minimized in the processing.

Figure 8:
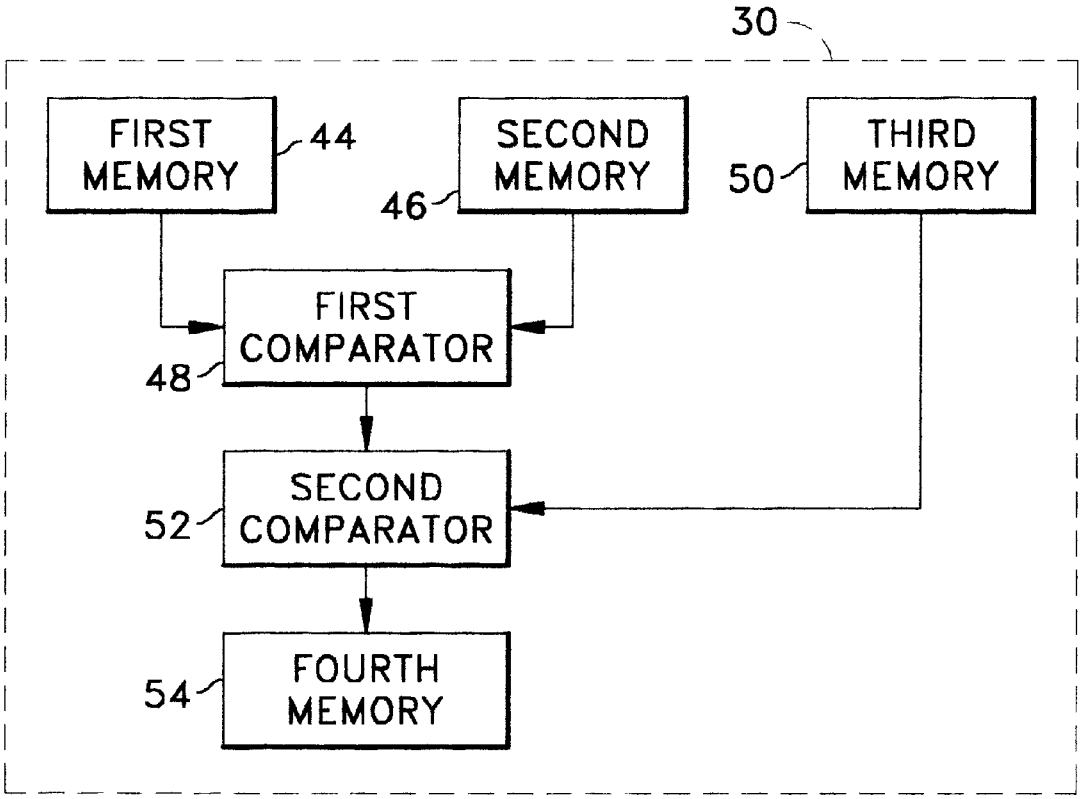
FIG. 8 is a functional flow diagram illustrating the background generator of the present invention.

There are two methods in accordance with the present invention to generate background images in each ROI. In the preferred method, shown in FIG. 8, first a single frame captured by the system is designated as a reference frame and is stored in a first memory 44. A time is associated with the reference frame stored in the first memory 44 relative to future positions to the reference frame. A next frame of the ROI is then captured in real time (preferably 33 ms later) and is stored in a second memory 46. The reference frame is subtracted from the next frame captured through the use of a first comparator 48. A two dimensional standard deviation of the difference (SDOD) of these two images is then calculated over each ROI. In this instance, the standard deviation is a single value taken over the whole two dimensional ROI, $$\mathrm{std}(ROI) = \left[ \sum_{all\,pixels} \frac{(x-\bar{x})^2}{(\#\mathrm{pixels}-1)} \right]^{\frac{1}{2}}$$

where $\bar{x}$ represents the mean value of the entire ROI.

The SDOD calculation in each ROI is represented continuously until a SDOD is found through the use of a second comparator 52 that is less than a given pre-selected threshold as stored in a third memory 50. A ROI that has a SDOD larger than the threshold is considered as containing a vehicle (either whole or in part). In contrast, a ROI that has a SDOD value less than the threshold is considered as background without a vehicle. Several SDOD's that have values less than the threshold must be selected before a SDOD with a true representation of the background image for a given ROI can be selected. This SDOD of the background image is stored in a fourth memory 54.

In this first, four SDOD's, for example, are selected that have values less than the threshold and a minimum SDOD is selected out of the four. Also, the four selected SDOD's must be separated in time by a preselected value. Once the minimum SDOD is chosen, as described, one of two frames originally processed to arrive at the minimum value is used as a representative of a vehicle free background frame in subsequent processing, as stored in the fourth memory 54. To account for changes in environmental conditions, the background is replaced every 15 minutes by the same process.

In the second method, manual control is used. For example, the initial setup and installation of the camera and signal processing unit are done by trained technical personnel. By manual inspection and with the use of automated inspection, such as specialized software inspection designed for such installation, the signal processing unit is guaranteed a ROI that is clear of any traffic when initially calculating a background value. Similar to the first method, subsequent updates of the background are the result of SDOD processing that has been limited to frames where the SDOD algorithm has precluded the possibility that any part of any vehicle is within the ROI.

Feature Curve Generation

Next, the system processes the video image data with feature curve generation 32. The feature curves are then processed and used to determine vehicle speed 34, vehicle length 36, and lane density 38. These results are then reported 40 and the system returns 42. Feature curve generation is accomplished by taking the standard deviation of the infrared video image over each ROI of FIG. 3 on a line by line basis. These individual values are compared with the position number of the line from which they are generated. This provides information on the spatial distribution of energy in the infrared spectra in a vertical direction in the ROI.

Traditionally, when applied to a two dimensional region, the standard deviation is a two dimensional function yielding a single value on the entire region. The standard deviation is calculated with the following expression, $$\mathrm{std}(i) = \left[ \sum_{i}^{n} \frac{(x-\bar{x})^2}{(n-1)} \right]^{\frac{1}{2}}$$

across each row (i) of pixels in the ROI. Here n varies from 1 up to the width of the ROI in pixels, i is the row number, x is the pixel value in the $i^{th}$ row and $\bar{x}$ is the mean value of the $i^{th}$ row of pixels.

Figure 5:
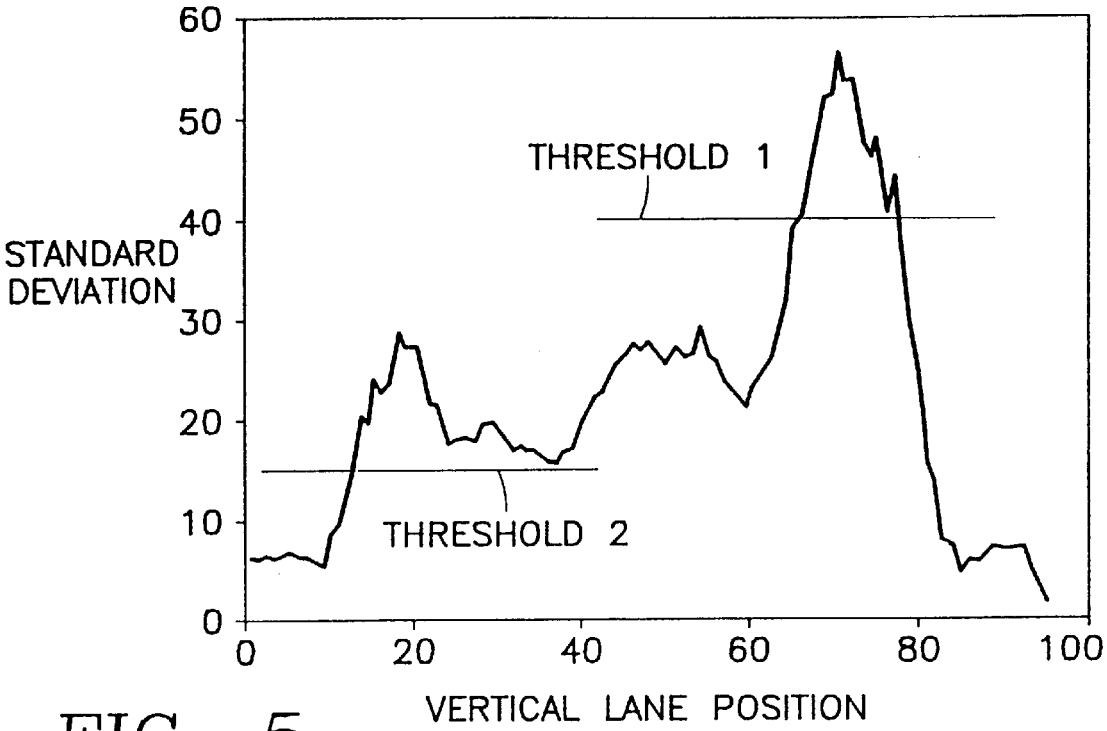
FIG. 5 is a first feature curve generated by the algorithm of FIG. 4.

FIG. 5 is a first feature curve generated by the system of FIG. 4. The horizontal axis of FIG. 5 corresponds to the precise row in the ROI in FIG. 3 from which the standard deviation has been calculated. The resulting value of the standard deviation in that row is compared with the vertical axis as shown in FIG. 5. The feature curves have characteristics that are repeatable and can be reliably associated with infrared views of vehicle attributes.

In the case of traffic with a direction into the camera, when a vehicle first enters a ROI monitored by the infrared camera, the heated portion of the vehicle enters first. A small percentage of U.S. vehicles will have rear or mid mounted engines and their feature curves will differ slightly. However, in the majority of cases, heat reflected from the roadbed surface is the first phenomena to enter the infrared ROI. This is followed closely by the engine and radiator except in limited cases (where vehicles have rear mounted engines, as discussed above).

For the infrared images, the heated region is at a discernible energy level that is higher than its surrounding areas. This is quantified by the energy collected by pixels at the heated regions. As a result, the pixels at the heated regions are represented by significantly higher 8 bit quantized values. Consequently, the pixels at the heated regions can reliably and repeatably be associated with the power generating and heat dissipating portions of the vehicle. In conjunction with the rest of the feature curve, the pixels at the heated regions provide a simple method to identify a leading edge and accurately count vehicles.

In the case of traffic moving in a direction away from the camera, the heated portion of the vehicle appears at a trailing edge of the feature curve due to muffler placement, reflected heat from the roadway surface, and the occlusion of forward reflected heat by the body of the vehicle. Thus, the trailing edge can be accurately identified in accordance with the discussion above related to the leading edge.

Vehicle Speed Assessment

Figure 6:
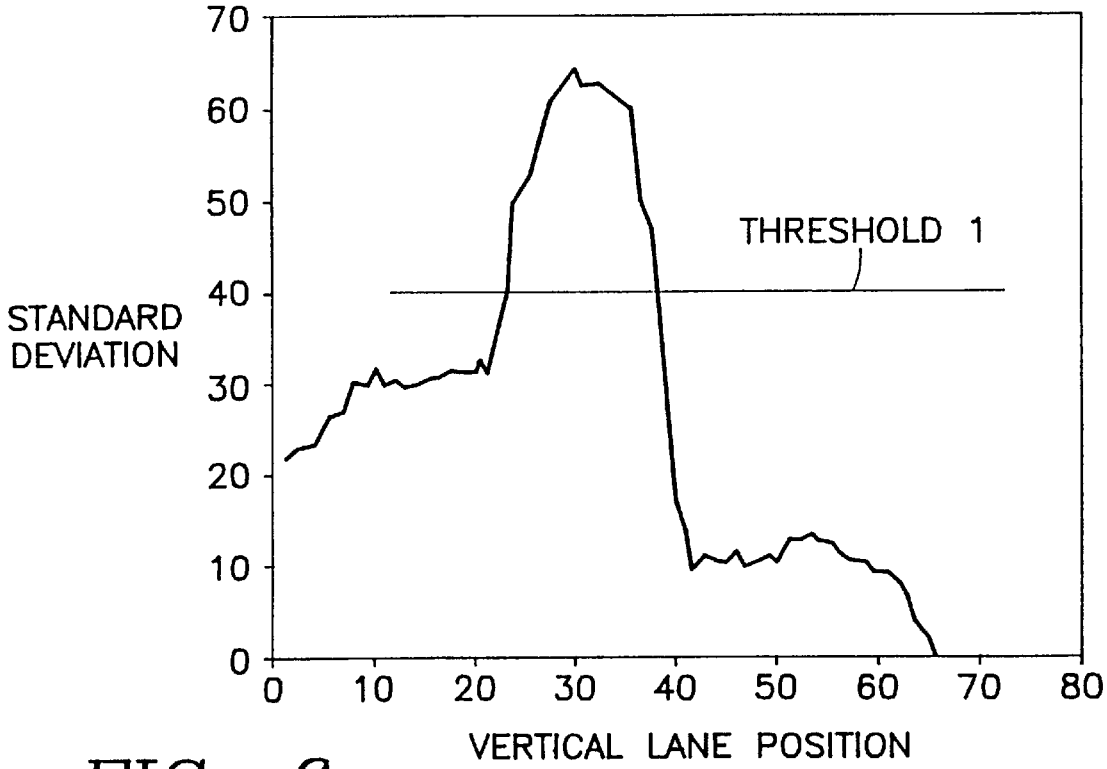
FIG. 6 is the leading edge of the first feature curve generated by the algorithm of FIG. 4.

As the vehicle progresses through the ROI, the leading edge of the feature curve will progress accordingly from frame to frame. FIG. 6 shows the leading edge of the feature curve generated by the algorithm of FIG. 4. By setting an adaptive threshold (threshold 1), the beginning of the leading edge of the vehicle is determined.

By following this data on a frame to frame basis and assuming oncoming traffic, the position of the leading edge of the vehicle in each ROI can be estimated. This displacement information along with the data sampling interval enables the estimate of the vehicle's velocity 34 in the direction through the frame.

Vehicle Length Classification

Each infrared camera specifies a field of view (FOV) for its pixel array and a per pixel FOV. If the camera's mounting parameters are known, the linear measure of each pixel's projection on the ground can be geometrically calculated. Pixels close to the bottom of the image will gather energy from a smaller area than pixels with projections further from the camera lens. The vehicle length is estimated with the real-time video data by identifying the leading and trailing edges of the same vehicle and by mapping pixels to a linear measure, such as feet or meters. The trailing edge of the vehicle can be estimated by setting a second adaptive threshold (threshold 2) as shown in FIG. 5. From this, the feature curves derived in FIGS. 5 and 6 are used to estimate vehicle length 36. Thus, given industry averages for different vehicle types, (compact, sub-compact, full-size, light truck, etc.) vehicles can be classified in real time.

Other Feature Curves and Statistics

Figure 7:
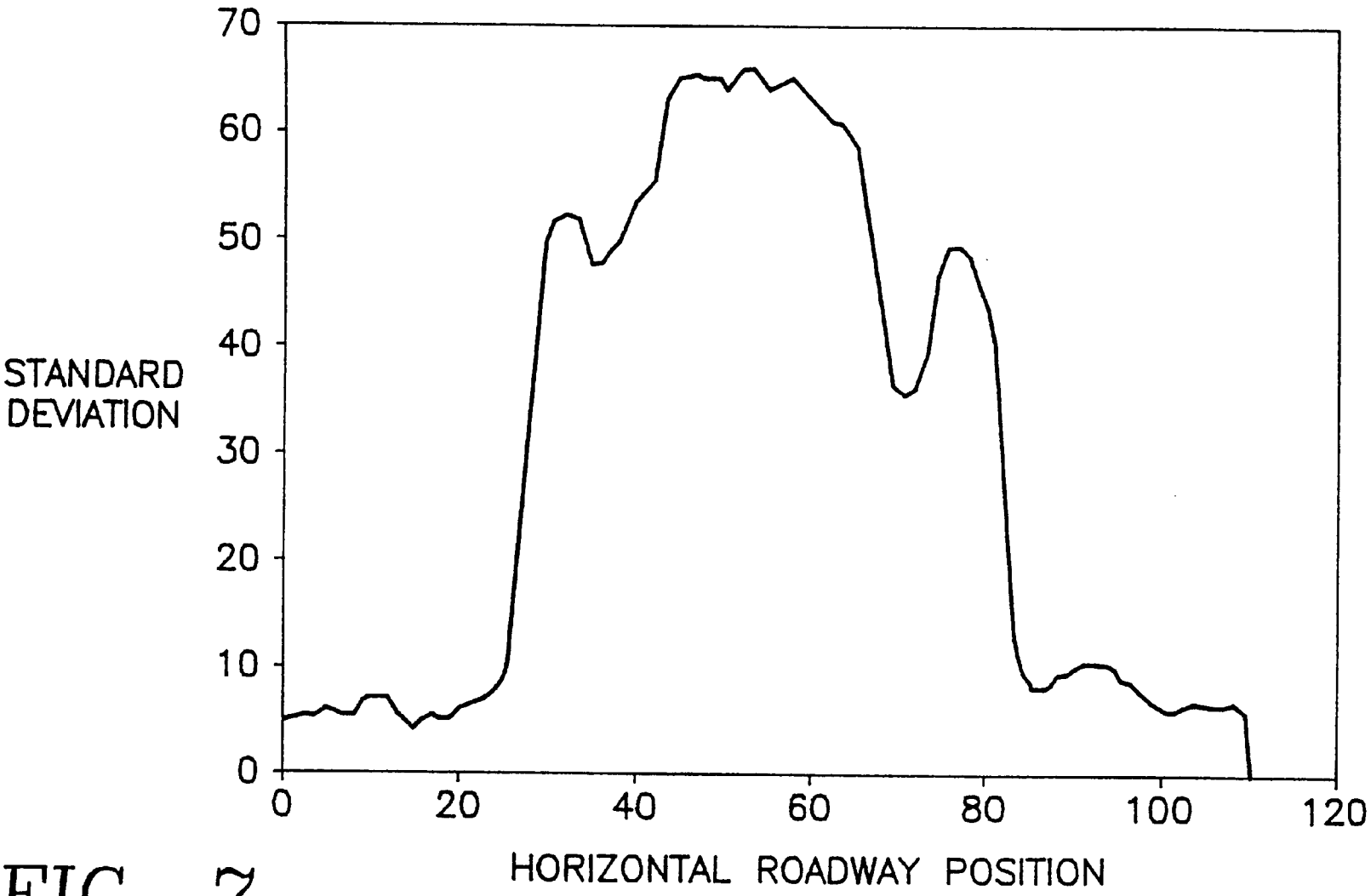
FIG. 7 is a second feature curve generated across the horizontal roadway positions and is a different embodiment of the present invention.

FIG. 7 is a feature curve generated by a different embodiment of the present invention. It is a sequence of one dimensional standard deviation taken on a column by column basis over the rectangular ROI. This feature curve can be utilized to differentiate a single car that enters into two adjacent ROI's versus two separated cars that enter the same two adjacent ROI's simultaneously.

As an alternative embodiment of the present invention, other statistical measures can be used as feature curves. These statistical measures include variance and mean. Each of these measures is implemented in a manner analogous to that described using the standard deviation.

In a recent test, the algorithm using standard deviation as feature curves counted vehicles with a 99.47% accuracy over a random 5.25 minute period during rush hour traffic on New York's Long Island Expressway.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto.

What is claimed is:

1. A traffic monitoring system for monitoring a thoroughfare with vehicles traveling on the thoroughfare, comprising:

a detector for capturing image data of the thoroughfare;

a processor in electrical communication with the detector for receiving the image data, the processor comprising:

1) a background generator operative to remove the effects of system noise, performance anomalies, and environmental parameters from the image data comprising:

(a) a first memory for storing a single frame captured from said detector as the reference frame;

(b) a second memory for storing a second single frame from said detector at a subsequent time;

(c) a third memory for storing a preselected value representing a frame without a vehicle;

(d) a first comparator for comparing said reference frame and said second single frame to determine a background frame;

(e) a second comparator for comparing said background frame to said predetermined value; and (f) a fourth memory for storing the background frame with least value compared to the predetermined value to designate a vehicle free background;

2) a curve generator in electrical communication with the background generator for producing statistical feature curves representing a series of quantitative values; and 3) an information processor in electrical communication with the curve generator for receiving the feature curves and deriving empirical data representing movement patterns of the vehicles within the thoroughfare based on the feature curves;

means in electrical communication with the processor for receiving the empirical data and determining from the empirical data an amount of vehicles, speed assessment of the vehicles, and a classification of the vehicles within the thoroughfare captured by the image data.

2. The invention as set forth in claim 1, wherein the detector is an infrared camera and the image data is captured as infrared spectra and represents a region of interest.

3. The invention as set forth in claim 2, wherein the each feature curve provides a spatial distribution of energy in the infrared spectra in a vertical direction in the region of interest.

4. The invention as set forth in claim 3, further comprising:

means for calculating standard deviations of the image data over each region of interest on a line by line basis; and means for comparing each standard deviation with a position number of the line from which the respective standard deviation is calculated.

5. The traffic monitoring system as set forth in claim 2, wherein the background generator includes a comparator for comparing the region of interest to a reference background set to remove the effects of differences in pixel sensitivities.

6. The traffic monitoring system as set forth in claim 2, wherein the background generator includes a comparator for comparing the region of interest to a reference background set to remove the effects of differences in lighting, shadows and weather.

7. The traffic monitoring system as set forth in claim 2, wherein the reference background comprises a two dimensional standard deviation of the difference between a first, reference frame of the region of interest and a next frame of the region of interest.

8. The invention as set forth in claim 1, wherein the processor is a signal processing unit.

9. The invention as set forth in claim 1, wherein the image data is received instantly by the processor and processed in real-time.

10. The invention as set forth in claim 1, wherein the image data is received by the processor and stored for future processing.

11. A traffic monitoring method for monitoring a thoroughfare with vehicles traveling on the thoroughfare, the method comprising;

capturing image data as infrared spectra of the thoroughfare represented by a region of interest defined by a vertical and horizontal axis with a plurality of rows of pixels;

processing said image data through a background generator operative to remove the effects of system noise, performance anomalies, and environmental parameters from the image data by completing the steps of:

(a) storing a single frame captured from said detector as the reference frame;

(b) storing a second single frame at a subsequent time;

(c) storing a predetermined value representing a frame without a vehicle;

(d) comparing said reference frame and said second single frame to determine a background frame;

(e) comparing said background frame to said predetermined value;

(f) storing the background frame with the least value compared to the predetermined value to indicate a vehicle free background;

(g) repeating said steps periodically to produce subsequent representative background frames to be used as a reference with respect to the dynamic conditions of the thoroughfare;

determining a spatial distribution of energy in the infrared spectra in a vertical direction in the region of interest by generating a feature curve for each region of interest;

deriving empirical data representing movement patterns of the vehicles within the thoroughfare based on the feature curves; and calculating from the empirical data an amount of vehicles, speed assessment of the vehicles, and a classification of the vehicles within the thoroughfare captured by the image data.

12. The invention as set forth in claim 11, wherein the spatial distribution is determined by:

calculating standard deviations of the image data over each region of interest on a line by line basis; and comparing each standard deviation with a position number of the line from which the respective standard deviation is calculated.

13. The invention as set forth in claim 12, wherein the standard deviations are calculated with the following expression:

$$\mathrm{std}(i) = \left[\sum_{i}^{n} \frac{(x-\bar{x})^2}{(n-1)}\right]^{\frac{1}{2}}$$

across each row of pixels in the region of interest, wherein n varies from 1 up to a width of the region of interest in pixels, i is the row number, x is the pixel value in the $i^{th}$ row, and $\bar{x}$ is the mean value of the $i^{th}$ row of pixels.

14. The invention as set forth in claim 11, wherein the empirical data is determined by:

comparing each standard deviation of the respective row of pixels with the vertical axis;

associating the compared standard deviations and vertical axis with infrared views of vehicle attributes.

15. A traffic monitoring system for monitoring a thoroughfare with vehicles traveling on the thoroughfare, comprising:

a detector for capturing image data of the thoroughfare, said data defined by a vertical and horizontal axis with a plurality of rows of pixels;

a processor in electrical communication with the detector for receiving the image data, the processor comprising:

1) a background generator operative to remove the effects of system noise, performance anomalies, and environmental parameters from the image data comprising:

(a) a first memory for storing a single frame captured from said detector as the reference frame;

(b) a second memory for storing a second single frame from said detector at a subsequent time;

(c) a third memory for storing a preselected value representing a frame without a vehicle;

(d) a first comparator for comparing said reference frame and said second single frame to determine a background frame;

(e) a second comparator for comparing said background frame to said predetermined value; and (f) a fourth memory for storing the background frame with least value compared to the predetermined value to designate a vehicle free background;

2) a curve generator in electrical communication with the background generator for producing statistical feature curves representing a series of quantitative values; and 3) an information processor in electrical communication with the curve generator for receiving the feature curves and deriving empirical data representing movement patterns of the vehicles within the thoroughfare based on the feature curves;

a computer program operating in electrical communication with said processor for producing statistical feature curves representing a series of quantitative values and for deriving empirical data representing movement patterns of the vehicles within the thoroughfare based on the feature curves; and means in electrical communication with the processor for receiving the empirical data and determining from the empirical data an amount of vehicles, speed assessment of the vehicles, and a classification of the vehicles within the thoroughfare captured by the image data.

16. The invention as set forth in claim 15, wherein the detector is an infrared camera and the image data is captured as infrared spectra.

17. The invention as set forth in claim 16, wherein each feature curve provides a spatial distribution of energy in the infrared spectra in a vertical direction in the region of interest.

18. The invention as set forth in claim 17, further comprising:

means for calculating standard deviations of the image data over each region of interest on a line by line basis; and means for comparing each standard deviation with a position number of the line from which the respective standard deviation is calculated.

19. The invention as set forth in claim 18, further comprising means for calculating the standard deviations with the following expression:

$$\mathrm{std}(i) = \left[\sum_{i}^{n} \frac{(x-\bar{x})^2}{(n-1)}\right]^{\frac{1}{2}}$$

across each row of pixels in the region of interest, wherein n varies from 1 up to a width of the region of interest in pixels, i is the row number, x is the pixel value in the $i^{th}$ row, and $\bar{x}$ is the mean value of the $i^{th}$ row of pixels.

20. The invention as set forth in claim 16, further comprising:

means for comparing each standard deviation of the respective row of pixels with the vertical axis; and means for associating the compared standard deviations and vertical axis with infrared views of vehicle attributes.

21. The traffic monitoring system as set forth in claim 15, wherein the background generator includes a comparator for comparing the region of interest to a reference background set to remove the effects of differences in pixel sensitivities.

22. The traffic monitoring system as set forth in claim 15, wherein the background generator includes a comparator for comparing the region of interest to a reference background set to remove the effects of differences in lighting, shadows and weather.

23. The traffic monitoring system as set forth in claim 15, wherein the reference background comprises a two dimensional standard deviation of the difference between a first, reference frame of the region of interest and a next frame of the region of interest.

* * * * *